US008187039B2

(12) United States Patent
Tsai

(10) Patent No.: US 8,187,039 B2
(45) Date of Patent: May 29, 2012

(54) SHARABLE SOCKET STRUCTURE

(76) Inventor: Chou Hsien Tsai, SinJhuang (TW)

( * ) Notice: Subject to any disclaimer, the term of this patent is extended or adjusted under 35 U.S.C. 154(b) by 0 days.

(21) Appl. No.: 12/683,399

(22) Filed: Jan. 6, 2010

(65) Prior Publication Data

US 2010/0173530 A1 Jul. 8, 2010

(30) Foreign Application Priority Data

Jan. 7, 2009 (TW) ..... 98200144 U
Jan. 12, 2009 (TW) ..... 98200502 U

(51) Int. Cl.
*H01R 24/00* (2006.01)

(52) U.S. Cl. ..... 439/660; 439/541.5; 439/607.35

(58) Field of Classification Search ..... 439/541.5, 439/660, 607.35
See application file for complete search history.

(56) References Cited

U.S. PATENT DOCUMENTS 7,517,253 B1 * 4/2009 Chiang ..... 439/660
2002/0042223 A1 * 4/2002 Belopolsky et al. ..... 439/541.5
2003/0008553 A1 * 1/2003 Oleynick et al. ..... 439/541.5
2006/0183371 A1 * 8/2006 Tsai ..... 439/541.5
2008/0166918 A1 * 7/2008 Yang et al. ..... 439/608
2010/0015855 A1 * 1/2010 Chiang ..... 439/660
2011/0039451 A1 * 2/2011 Tung ..... 439/620.23

* cited by examiner

*Primary Examiner* — Hien Vu
(74) *Attorney, Agent, or Firm* — Pro-Techtor Int'l Services

(57) ABSTRACT

A sharable socket structure includes a plastic base and rows of first and second terminals arranged in the base. The base has a common slot for accommodating two connectors with different interfaces. The slot is formed with an inserting port and a tongue is disposed in the slot. Each terminal has a contact, an extension, a fixing portion and a pin. The contacts of the first and second terminals are disposed on the tongue and electrically connected to two connectors, respectively. The contacts of the second terminals are closer to the port than the contacts of the first terminals. A step is formed between X coordinates of the contact and extension of the second terminal in a sequentially arranging direction of the terminals such that the contact of the second terminal partially overlaps with the contact of the first terminal neighboring the second terminal on the X coordinates.

10 Claims, 15 Drawing Sheets

SHARABLE SOCKET STRUCTURE

BACKGROUND OF THE INVENTION

1. Field of the Invention

The invention relates to an electrical connector, and more particularly to a sharable socket structure.

2. Related Art

The universal serial bus (USB) is the most popular interface which satisfies the signal transmission specification in the computer. The connector socket and the transmission cable satisfying this specification can connect the computer to the peripheral apparatus, such as a mouse or a keyboard, and can immediately work to achieve the plug-and-play function.

In order to satisfy the requirement of the high flow data transmission, another transmission specification, such as external serial ATA (eSATA), satisfying the plug-and-play function is also proposed, wherein the transmission amount of this specification is higher than that of USB.

The interface of USB is not compatible with that of eSATA. So, these two similar sockets cannot be shared.

Referring to FIG. 1, a conventional signal line connector includes a plastic base 10, four first terminals 20, seven second terminals 25 and a metal casing 30.

The plastic base 10 has a USB connector socket 11 and an eSATA connector socket 15. A tongue 12 is disposed in the USB connector socket 11, and a tongue 16 is disposed in the eSATA connector socket 15.

The first terminal 20 is fixed to the plastic base 10 and has a pin 22 and a contact 21, which can elastically move up and down. The contact 21 is disposed in the USB connector socket 11 and protrudes downwardly from the tongue 12. The pin 22 extends downwardly from the plastic base 10 and is thus connected to a circuit board 35.

The second terminal 25 is mounted on the plastic base 10 and has a pin 27 and a contact 26, which cannot elastically move. The contact 26 is disposed in the eSATA connector socket 15 and protrudes upwardly from the tongue 16. The pin 22 extends downwardly from the plastic base 10 and is thus connected to the circuit board 35.

The metal casing 30 covers peripheral surfaces and a top surface of the plastic base. One surface of the metal casing 30 is formed with openings 31 and 32 for exposing the USB connector socket 11 and the eSATA connector socket 15.

As shown in FIG. 2, a rectangular USB connector 40 satisfying the USB 2.0 specification has a plastic body 41, an external iron casing 42 and four terminal connection points 43. The external iron casing 42 is formed with a chamber 44 after covering the plastic body 41. The hatched region represents the plastic body 41, and the four terminal connection points 43 have no elasticity and are exposed to the chamber 44. As shown in FIG. 1, the chamber 44 of the USB 2.0 connector 40 corresponds to the tongue 12 of the USB connector socket 11 to be inserted for electrical connection. At this time, its terminal connection points 43 are in elastic contact with the contacts 21 of the first terminal 20.

As shown in FIG. 3, an eSATA connector 45 substantially has a rectangular shape and has two slightly protruding sides. The eSATA connector 45 has a plastic body 46, an external iron casing 47 and four terminal connection points 48. The middle of the plastic body 46 is formed with a chamber 49, wherein the hatched region represents the plastic body 46. The seven terminal connection points 48 have the elasticity of up and down movement and are exposed to the chamber 49. As shown in FIG. 1, the chamber 49 of the eSATA connector 45 corresponds to the tongue 16 of the eSATA connector socket 15 to be inserted for electrical connection. At this time, its terminal connection points 48 are in elastic contact with the contacts 26 of the second terminal 25.

The USB connector socket 11 disposed on the conventional signal line connector is only suitable for the inserted USB connector, while the eSATA connector socket 15 is only suitable for the inserted eSATA connector. That is, the socket cannot be shared by the USB and eSATA connectors. However, the functional requirements of the computer are gradually increased. According to different requirements of the users, the computer may need to be connected to four signal lines with the USB connectors but need not to be connected to the signal line with the eSATA connector. Alternatively, the computer may need not to be connected to the signal line with the USB connector but need to be connected to four signal lines with the eSATA connectors. Thus, the computer has to be provided with four USB connector sockets and four eSATA connector sockets in order to satisfy various requirements of the users. Therefore, the sockets occupy more space in the chamber and the cost is increased.

In order to facilitate the usage, the shareable socket with the signal line of the USB connector and the signal line of the eSATA connector has been proposed. However, the connection points of the USB connector partially overlap with the connection points of the eSATA connector on the X coordinates of the sequentially arranging direction of the terminals. So, the currently designed shareable sockets are classified into the following two kinds.

In the first kind, four first terminals connected to the connection points of the USB connector and seven second terminals connected to the connection points of the eSATA connector are respectively disposed on two surfaces of the tongue. However, the thickness of the tongue is so thin that the space for the elastic movement of the first terminal is very small.

In the second kind, four first terminals connected to the connection points of the USB connector and seven second terminals connected to the connection points of the eSATA connector are disposed on the same surface of the tongue. The four first terminals have to be disposed in the gaps between the seven second terminals. So, when the USB connector is connected thereto, the connection points of the USB connector cannot be precisely aligned with and connected to the first terminals. Thus, the electrical connection reliability is very small.

Furthermore, in order to shorten the transmission time, the current USB connector has been developed to the specification of USB 3.0. The connection interface of the USB 3.0 connector has an additional row of terminals as compared with the USB 2.0 connector. So, the transmission speed becomes higher. Thus, if the USB 3.0 connector and the eSATA connector have to be integrated, then three rows of terminals have to be provided in the shareable socket, and the difficulty in manufacturing may be increased.

SUMMARY OF THE INVENTION

It is therefore a main object of the invention to provide a sharable socket structure having the sufficient space for elastic movement of the elastic contacts of the terminals.

Another object of the invention is to provide a sharable socket structure, in which two rows of terminals are formed on the same copper sheet by way of pressing, the pressed terminals are sequentially arranged and connected to a material tape while the plating may be performed. The terminals may be assembled into the plastic base at a time so that the material is saved, the labor is saved and the manufacturing cost is reduced.

The invention achieves the above-identified objects by providing a sharable socket structure including a plastic base, one row of first terminals and one row of second terminals. The plastic base has a common slot for accommodating at least two connectors with different connection interfaces. A front end of the common slot is formed with an inserting port and a tongue is disposed in the common slot. The one row of first terminals is separately arranged in the plastic base. Each of the first terminals has a contact, an extension, a fixing portion and a pin. The contacts of the first terminals are disposed on the tongue in the common slot, and the contacts of the first terminals are electrically connected to a connector. The one row of second terminals is separately arranged in the plastic base. Each of the second terminals has a contact, an extension, a fixing portion and a pin. The contacts of the second terminals are disposed on the tongue in the common slot. The contacts of the second terminals are closer to the inserting port than the contacts of the first terminals are. The contacts of the second terminals are to be electrically connected to another connector. A step is formed between X coordinates of the contact and the extension of at least one of the second terminals in a sequentially arranging direction of the terminals such that the contact of the second terminal partially overlaps with the contact of the first terminal neighboring the second terminal on the X coordinates.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE INVENTION

The present invention will be apparent from the following detailed description, which proceeds with reference to the accompanying drawings, wherein the same references relate to the same elements.

Figure 2:
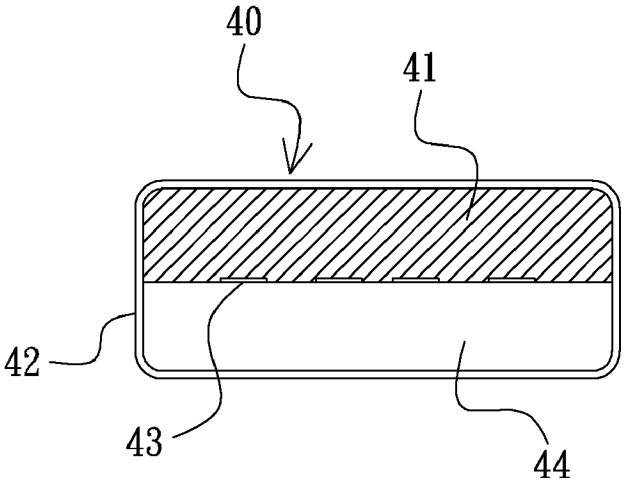
FIG. 2 (Prior Art)
FIG. 2 is a schematic front view showing a conventional USB connector.
Figure 3:
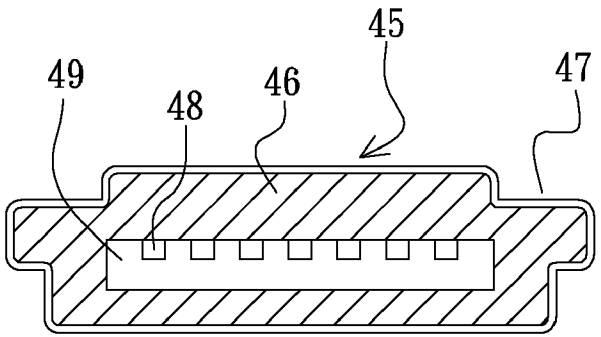
FIG. 3 (Prior Art)
FIG. 3 is a schematic front view showing a conventional eSATA connector.
Figure 1:
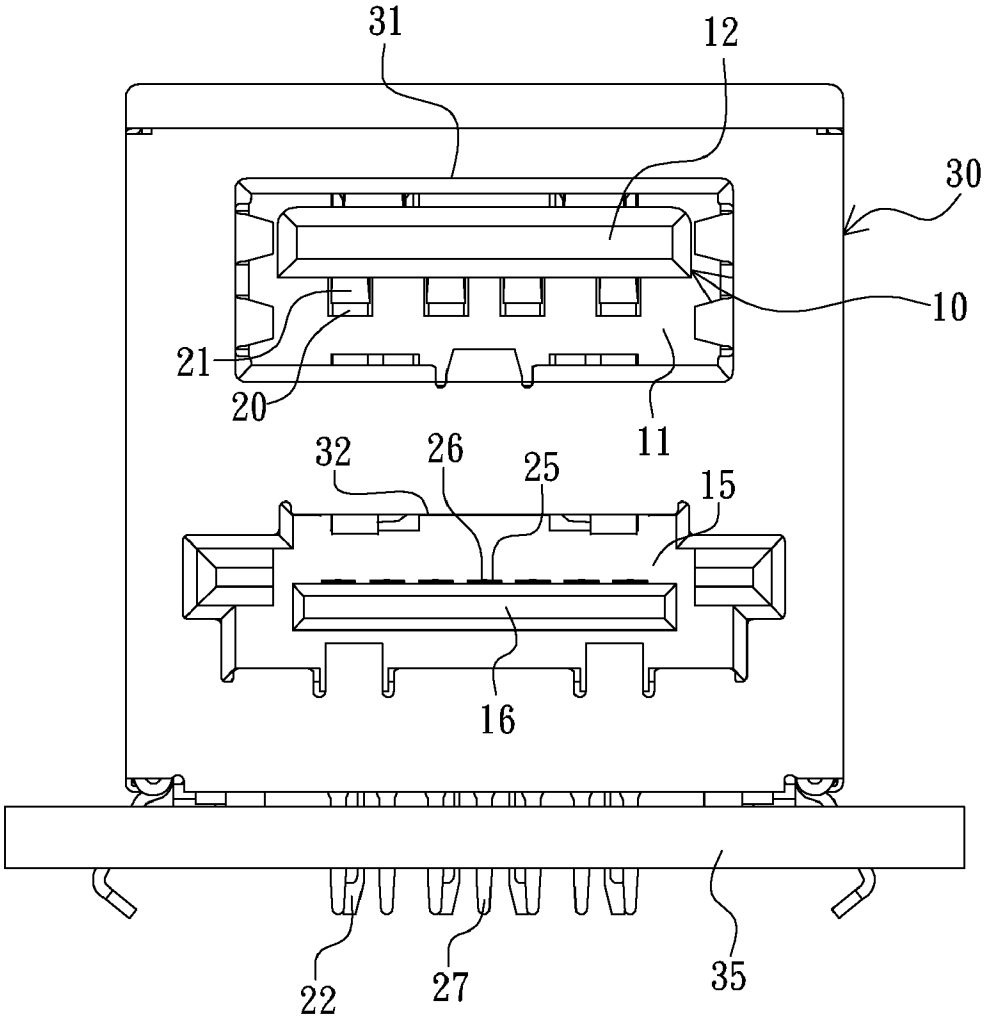
FIG. 1 (Prior Art)
FIG. 1 is a front view showing a conventional signal line connector.
Figure 4:
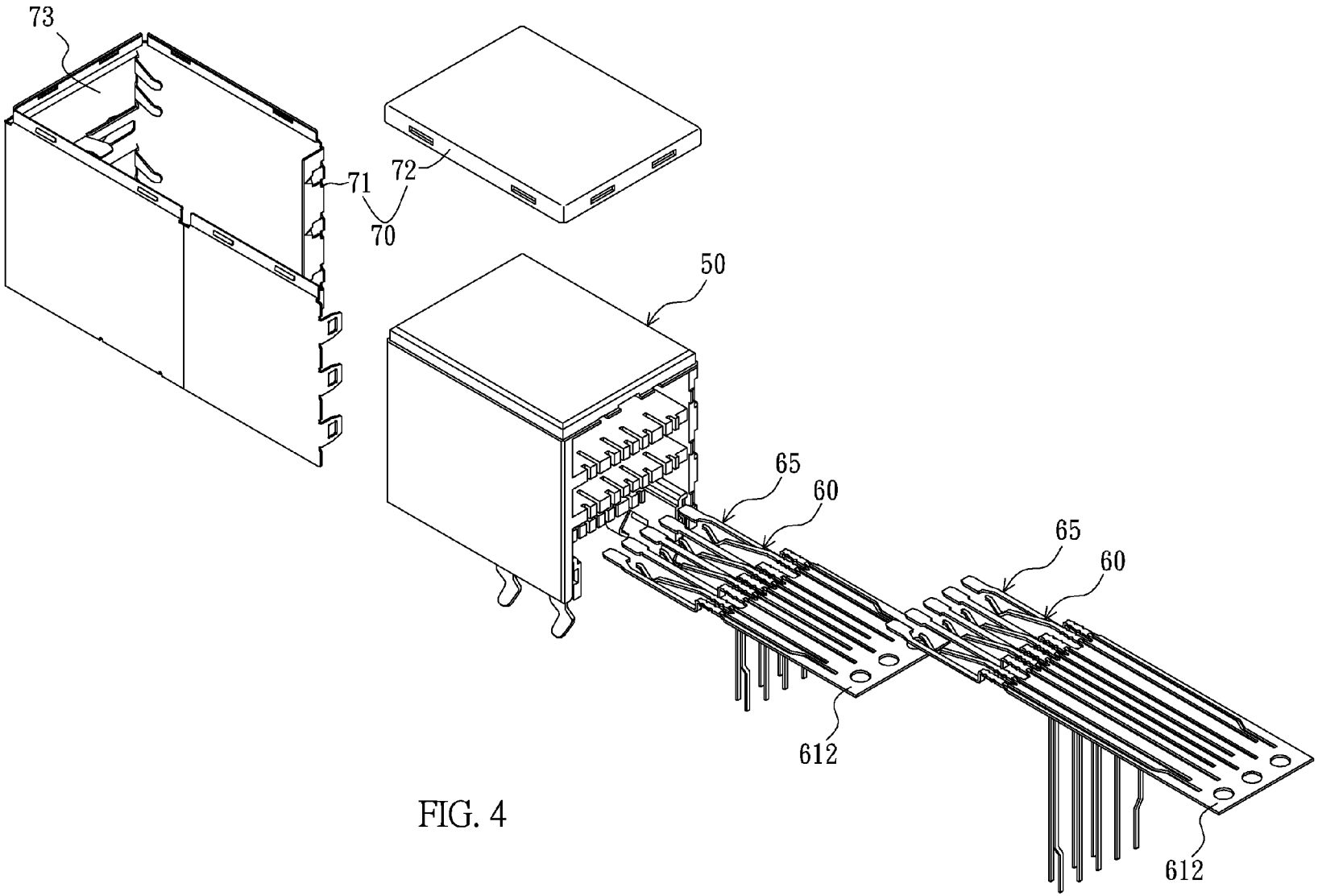
FIG. 4 is a pictorially exploded view showing a first embodiment of the invention.
Figure 5:
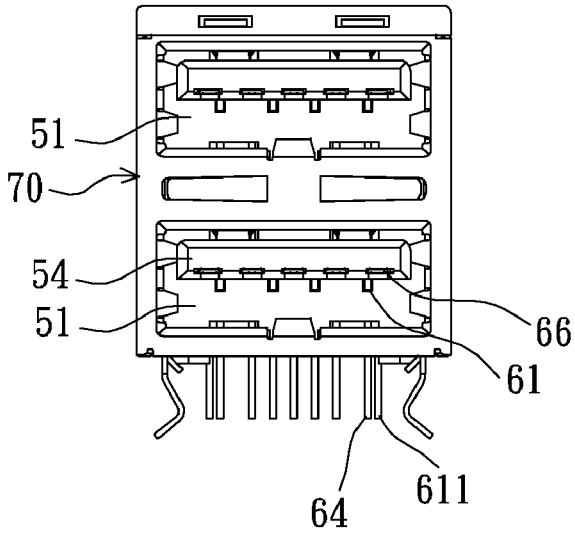
FIG. 5 is an assembled front view showing the first embodiment of the invention.
Figure 6:
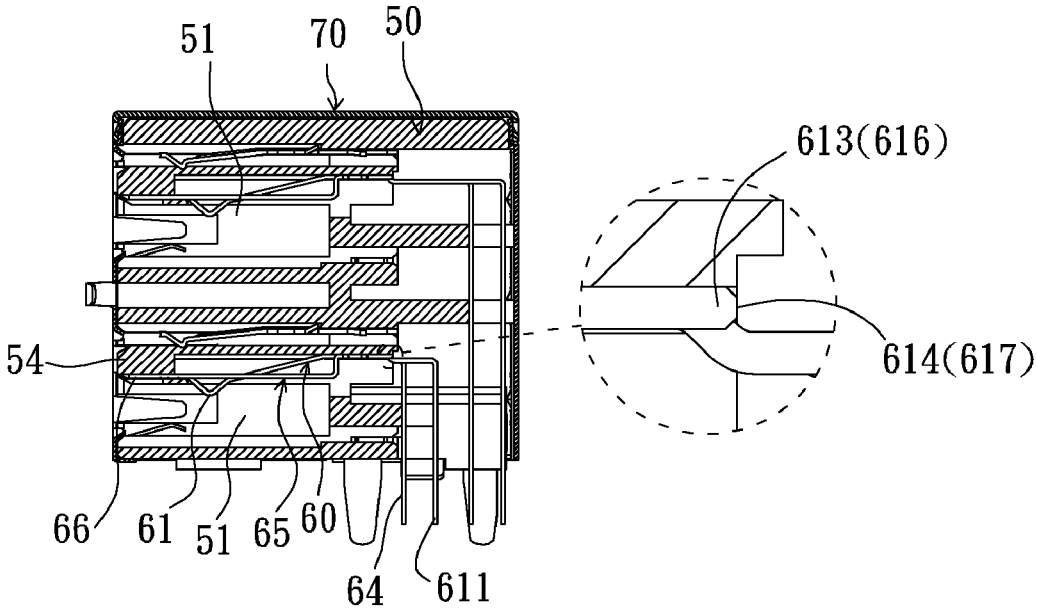
FIG. 6 is an assembled side view showing the first embodiment of the invention.

Referring to FIGS. 4 to 6, the first embodiment of the invention is a dual-layer sharable socket structure and includes a plastic base 50, two rows of first terminals 60, two rows of second terminals 65 and one metal casing 70.

The plastic base 50 has two common slots 51 stacked together, and the front end of the common slot 51 is an inserting port. A tongue 54 is disposed in the common slot. The electronic element to be inserted into the common slot 51 is a USB connector or USB plug. The USB connector may have the connection interface of USB 2.0 or USB 3.0.

Figure 7:
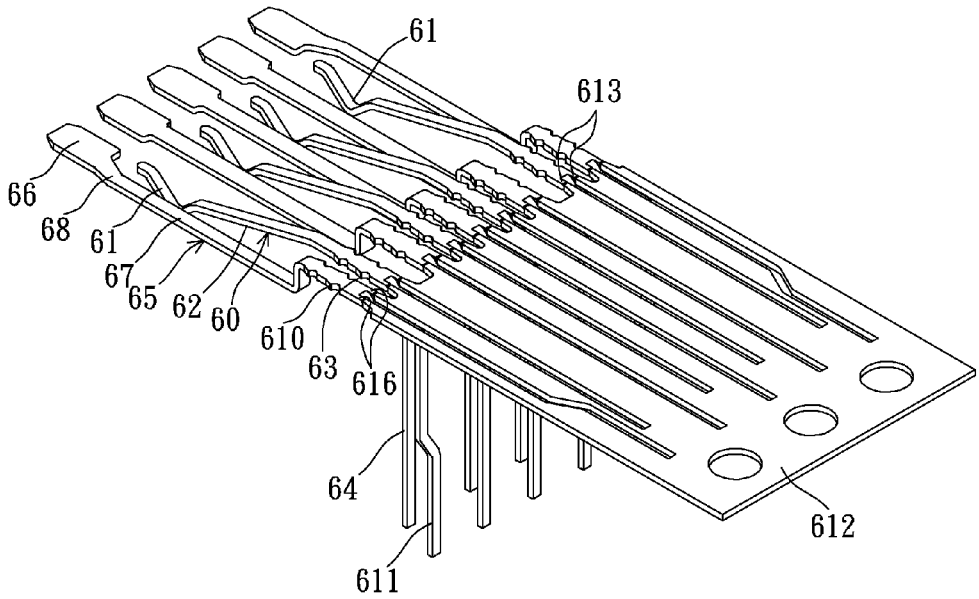
FIG. 7 is a pictorial view showing sequentially arranged terminals according to the first embodiment of the invention.
Figure 8:
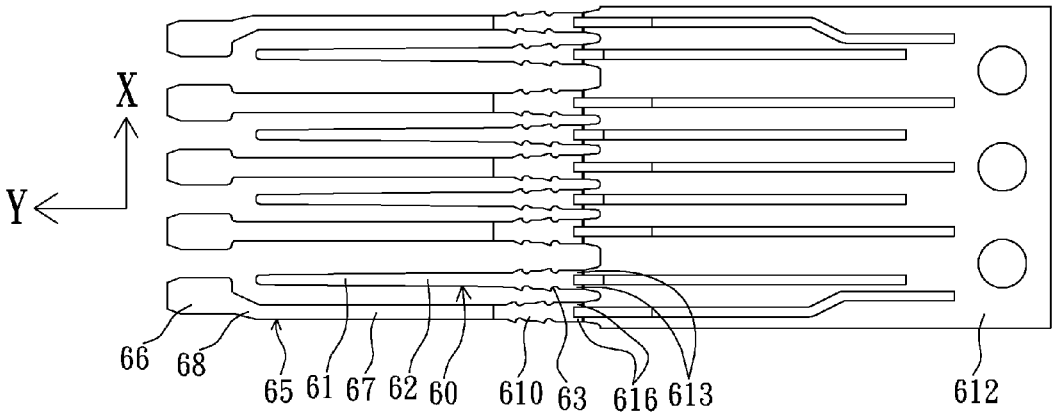
FIG. 8 is a top view showing the sequentially arranged terminals according to the first embodiment of the invention.

As shown in FIGS. 7 and 8, the one row of first terminals 60 and the one row of second terminals 65 are simultaneously formed on a copper sheet by way of pressing. After pressing, the rear end of the fixing portion is connected to a material tape 612, and the overall structure is plated such that the surfaces of one row of first terminals 60 and one row of second terminals 65 are formed with plating layers. After the one row of first terminals 60 and the one row of second terminals 65 are assembled with the plastic base 50, the connected material tape 612 is removed.

The one row of first terminals 60 includes four first terminals 60 separately disposed in the common slot 51 of the plastic base 50. Each of the first terminals 60 has a contact 61, an extension 62, a fixing portion 63 and a pin 64. The contacts 61 of the one row of first terminals may be electrically connected to the USB 2.0 connector. The contact 61 may elastically move up and down and protrude downwardly from the tongue 54. The fixing portion 63 is pressed tightly against the plastic base. Two sides of the rear end of the fixing portion 63 are formed with connection projections 613 connected to the material tape 612. After the material tape 612 is broken, the broken portion between the connection projection 613 and the material tape 612 is formed with a broken surface 614 without a plating layer. The pin 64 extends downwardly and then longitudinally and then protrudes downwardly from the plastic base 50.

The one row of second terminals 65 includes five second terminals 65 separately arranged in the common slot 51 of the plastic base 50. The second terminals 65 and the first terminals 60 are staggered when viewed from the top side. The X coordinates of the fixing portions and extensions of the one row of first terminals 60 and the one row of second terminals 65 in the sequentially arranging direction of the terminals are completely staggered. The second terminal 65 has a contact 66, an extension 67, a fixing portion 610 and a pin 611. The contacts 66 of the one row of second terminals 65 may be electrically connected to the USB 3.0 connector. The contact 66 cannot elastically move and is in contact with the lower surface of the front end of the tongue 54, and is closer to the inserting port of the common slot 51 than the contact 61 of the first terminal 60. The fixing portion 610 tightly presses the plastic base. Two sides of the rear end of the fixing portion 63 are formed with connection projections 616 connected to the material tape 612. After the material tape 612 is broken, the broken portion between the connection projection 616 and the material tape 612 is formed with a broken surface 617 without a plating layer. The pin 611 extends downwardly and then longitudinally and then protrudes downwardly from the plastic base 50. The pins 611 of the one row of second terminals 65 are arranged in a row disposed behind the pins 64 of the first terminals 60.

The contacts 61 of the first terminals 60 partially overlap with the contacts 66 of the second terminals 65 on the X coordinates. So, turning portions 68 are provided between the contacts 66 and the extensions 67 of the portion of the second terminals 65 in order to make the second terminals 65 and the first terminals 60 be staggered when viewed from the top. Thus, a step exists between the X coordinates of the contact 66 and the extension 67 in the sequentially arranging direction of the terminals. Therefore, the extensions 62 of the first terminals 60 and the extensions 67 of the second terminals 65 may be staggered. However, the contact 66 of the second terminal 65 may be located in front of the contact 61 of the first terminal 60 according to the turning portion 68 so that the contacts of the first and second terminals overlap with each other on the X coordinates but are staggered when the overall structure of the first and second terminals is viewed from the top.

All the connection projections 613 and 616 of the broken surfaces 614 and 617 without the plating layer of the one row of first terminals 60 and the one row of second terminals 65 are assembled into one common slot 51 to be in the same row and at the same height.

The metal casing 70 covers the plastic base 50 and includes a main body 71 and an upper cover 72. The main body 71 includes peripheral surfaces connected together. The front surface of the main body 71 is formed with two openings 73 for exposing the two common slots 51 of the plastic base 50.

Figure 9:
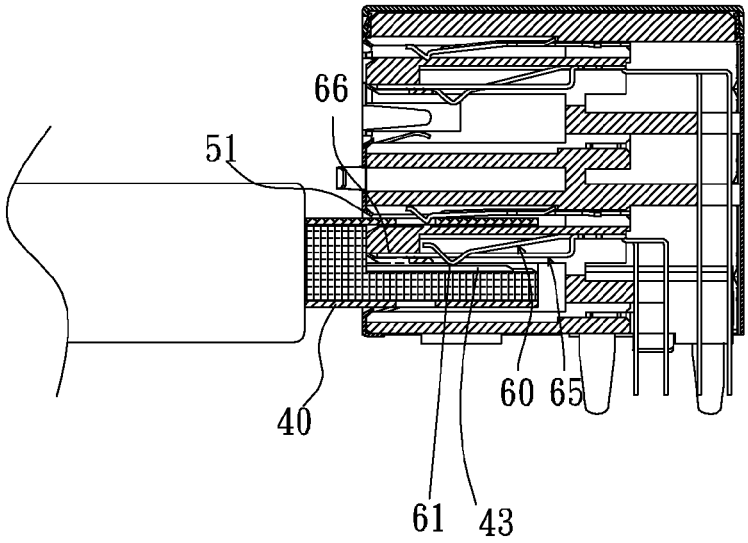
FIG. 9 is a side view showing the usage state of the first embodiment of the invention when the USB 2.0 connector is inserted.

As shown in FIG. 9, when a USB 2.0 connector 40 is inserted into the common slot 51, it can be engaged and positioned with the common slot 51. The four terminal connection points 43 are aligned with and in elastic contact with the four contacts 61 of the first terminals 60 and cannot touch the five contacts 66 of the second terminals 65 at the lower connection position so that the function will not be influenced by the short-circuited condition.

Figure 10:
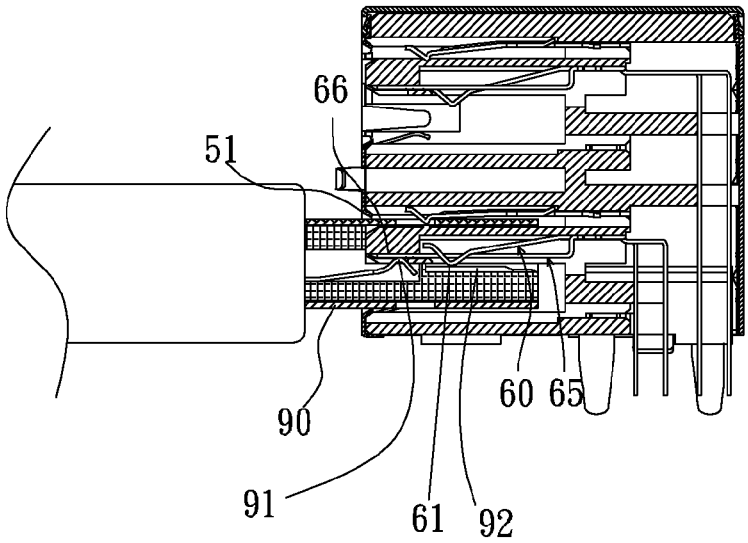
FIG. 10 is a front view showing the usage state of the first embodiment of the invention when the USB 3.0 connector is inserted.

As shown in FIG. 10, when a USB 3.0 connector 90 is inserted into the common slot 51, it can be engaged with and positioned with the common slot 51. The four terminal connection points 92 at the front section of the connector 90 are aligned with and in elastic contact with the contacts 61 of the first terminals 60. The five terminal connection points 91 at the rear end of the connector 90 are aligned with and in elastic contact with the five contacts 66 of the second terminals 65.

According to the description stated hereinabove, it is obtained that the common slot 51 may be shared and inserted by the USB 2.0 connector 40 and the USB 3.0 connector 90, and the plastic base 50 has two common slots 51. Thus, the application of the computer apparatus can become more convenient.

In addition, the second terminals 65 and the first terminals 60 are staggered when viewed from the top. So, when the first terminal elastically moves, it is unnecessary to consider whether it interferes with the second terminal 65. So, its space for elastic movement is large.

Furthermore, the two rows of terminals may be formed on the same copper sheet by way of pressing, the sequentially arranged terminals after pressing are connected to a material tape, plating can be simultaneously performed on the material tape and the terminals, and the terminals may be assembled into the plastic base at a time so that the material is saved, the labor is saved and the manufacturing cost is lowered.

Figure 11:
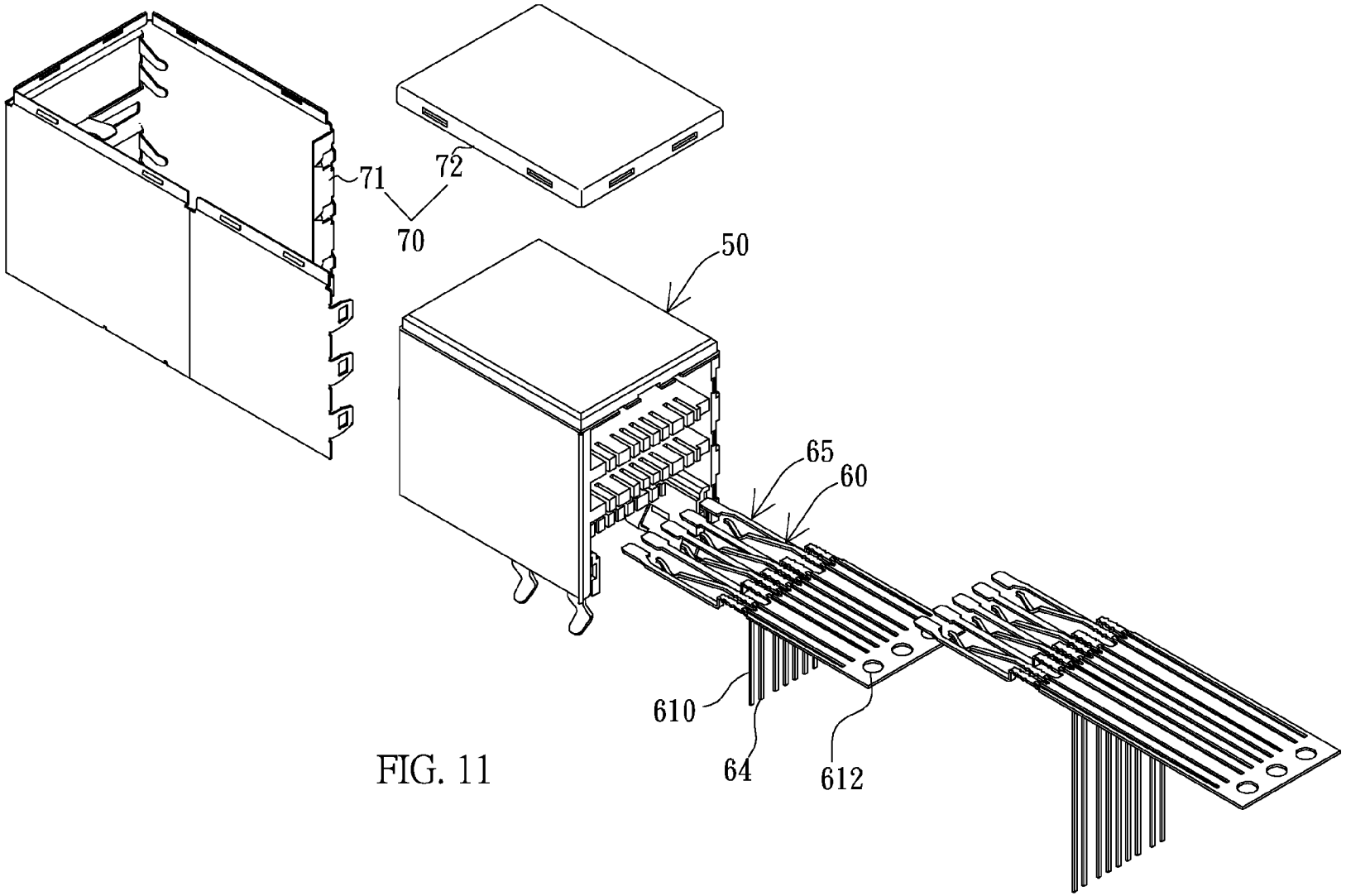
FIG. 11 is a pictorially exploded view showing a second embodiment of the invention.

As shown in FIG. 11, the second embodiment of the invention is almost the same as the first embodiment except that the pins 64 of the one row of first terminals 60 and the pins 611 of the one row of second terminals 65 of this embodiment are arranged in the same row.

Figure 12:
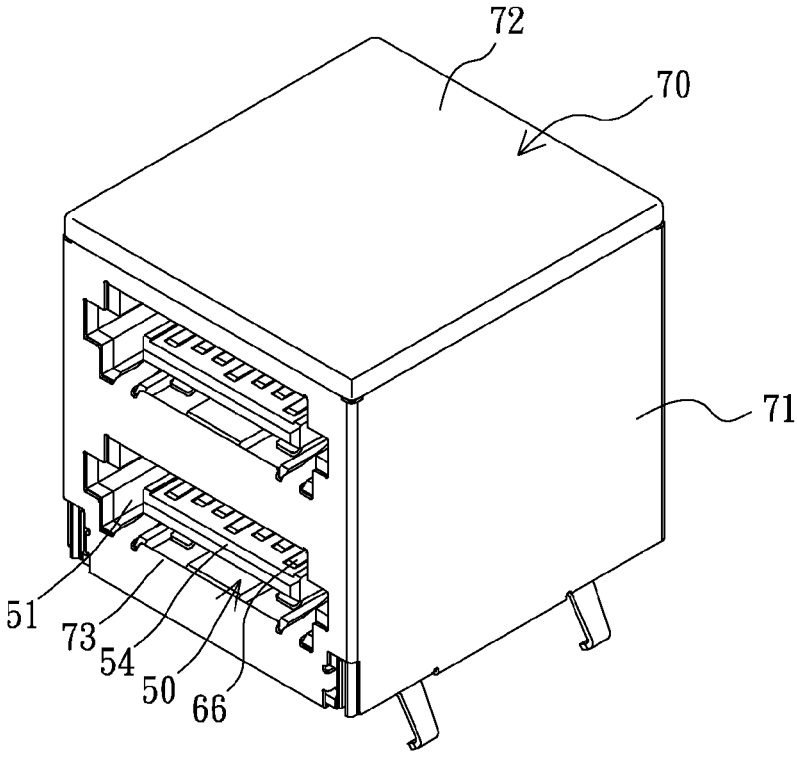
FIG. 12 is a pictorially assembled view showing a third embodiment of the invention.
Figure 13:
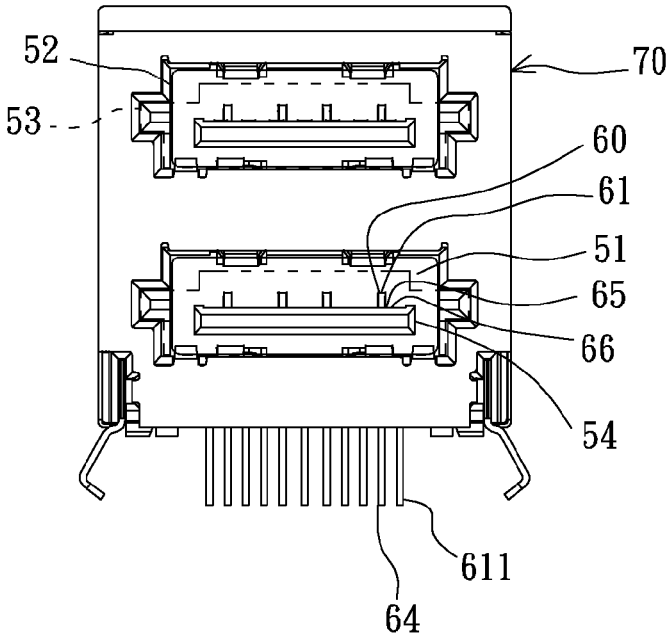
FIG. 13 is an assembled front view showing the third embodiment of the invention.
Figure 14:
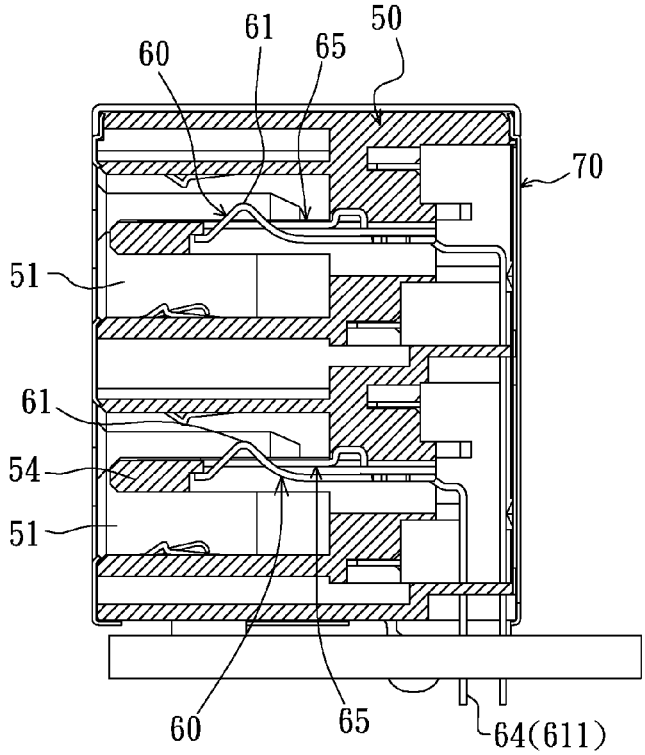
FIG. 14 is an assembled side view showing the third embodiment of the invention.

As shown in FIGS. 12 to 14 the third embodiment of the invention includes a plastic base 50, two rows of first terminals 60, two rows of second terminals 65 and a metal casing 70.

The plastic base 50 has two common slots 51 stacked together. The front end of the plastic base 50 is an inserting port of the common slot 51, and a tongue 54 is disposed in the common slot. The common slot 51 includes a first slot 52 and a second slot 53. The height of the second slot 53 is smaller than that of the first slot 52, and the width of the second slot 53 is greater than that of the first slot 52. The first and second slots 52 and 53 share a common chamber. The first slot 52 may be engaged with an inserted USB connector, while the second slot 53 may be engaged with an inserted eSATA connector.

Figure 17:
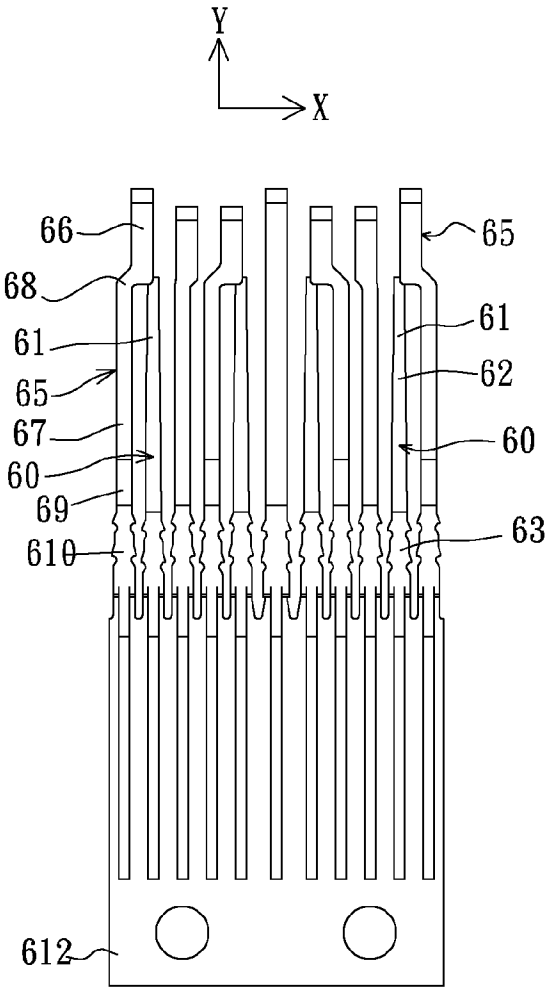
FIG. 17 is a top view showing the sequentially arranged terminals according to the third embodiment of the invention.
Figure 16:
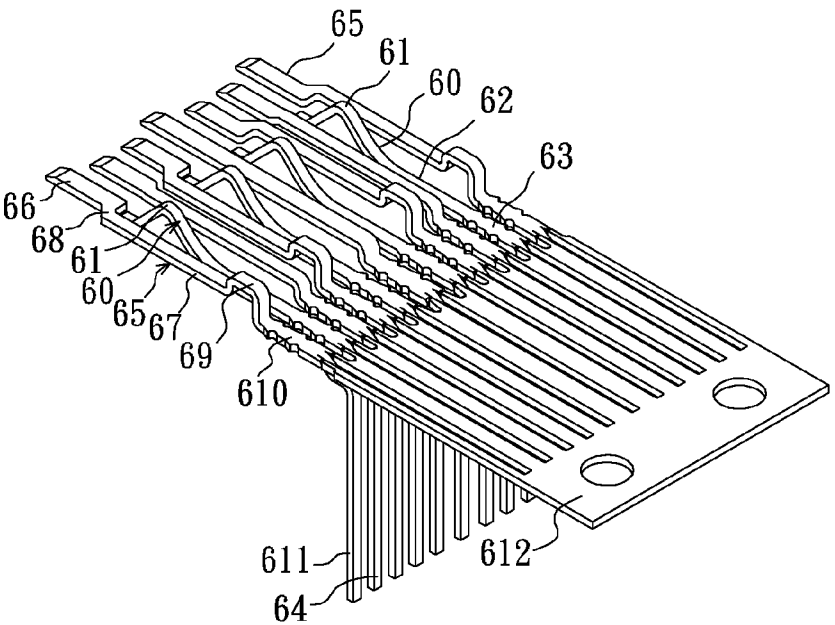
FIG. 16 is a pictorial view showing sequentially arranged terminals according to the third embodiment of the invention.

As shown in FIGS. 16 and 17, the one row of first terminals 60 includes four first terminals 60 separately arranged in the common slot 51 of the plastic base 50. The first terminal 60 has a contact 61, an extension 62, a fixing portion 63 and a pin 64. The contact 61 may elastically move and protrude upwardly from the middle section of the tongue 54. The fixing portion 63 tightly presses against the plastic base. The pin 64 extends downwardly and then longitudinally and then protrudes downwardly from the plastic base 50.

The one row of second terminals 65 includes seven second terminals 65 separately mounted on the common slot 51 of the plastic base 50. The second terminal 65 has a contact 66, an extension 67, a fixing portion 610 and a pin 611. The contact 66 cannot elastically move and is in contact with the upper surface of the front section of the tongue 54. The contacts 66 of the second terminals 65 and the contacts 61 of the first terminals 60 are staggered when viewed from the top, and are different from each other on the Y coordinates of the terminal extending direction. The contact 66 of the second terminal 65 is closer to the inserting port of the common slot 51 than the contact 61 of the first terminal 60 is. The fixing portion 610 tightly presses against the plastic base. The pin 611 extends downwardly and then longitudinally and protrudes downwardly from the plastic base 50.

The four first terminals and the seven second terminals are simultaneously formed on a copper sheet by way of pressing. After pressing, the rear ends of the fixing portions are connected to the material tape 612. Because the contacts 61 of the first terminals 60 and the contacts 66 of the second terminals 65 on the X coordinates are respectively arranged according to the USB-2.0 and eSATA standard interfaces, the contacts thereof partially overlap with each other on the X coordinates. So, the turning portions 68 are provided between the contacts 66 and the extensions 67 of the portion of the second terminals 65 in order to make the second terminals 65 and the first terminals 60 be staggered when viewed from the top. Thus, a step exists between the X coordinates of the contact 66 and the extension 67 in the sequentially arranging direction of the terminals. Therefore, the extensions 62 of the first terminals 60 and the extensions 67 of the second terminals 65 may be staggered. However, the contact 66 of the second terminal 65 may be located in front of the contact 61 of the first terminal 60 according to the turning portion 68 so that the contacts thereof overlap with each other on the X coordinates but are staggered when viewed from the top. In addition, because the contact 61 of the first terminal 60 is a convex contact, its developed length gets longer. Thus, the extension 67 of the second terminal 65 having the turning portion 68 is formed with a bending portion 69 so that the developed length can be increased. Thus, no overlap occurs when the second terminal 65 and its neighboring first terminal 60 are developed. Therefore, the first terminals 60 and the second terminals 65 can be formed on the same copper sheet by way of pressing.

The metal casing 70 covers the plastic base 50 and includes a main body 71 and an upper cover 72. The main body 71 includes peripheral surfaces connected together. The front surface of the main body 71 is formed with two openings 73 for exposing the two common slots 51 of the plastic base 50.

Figure 15:
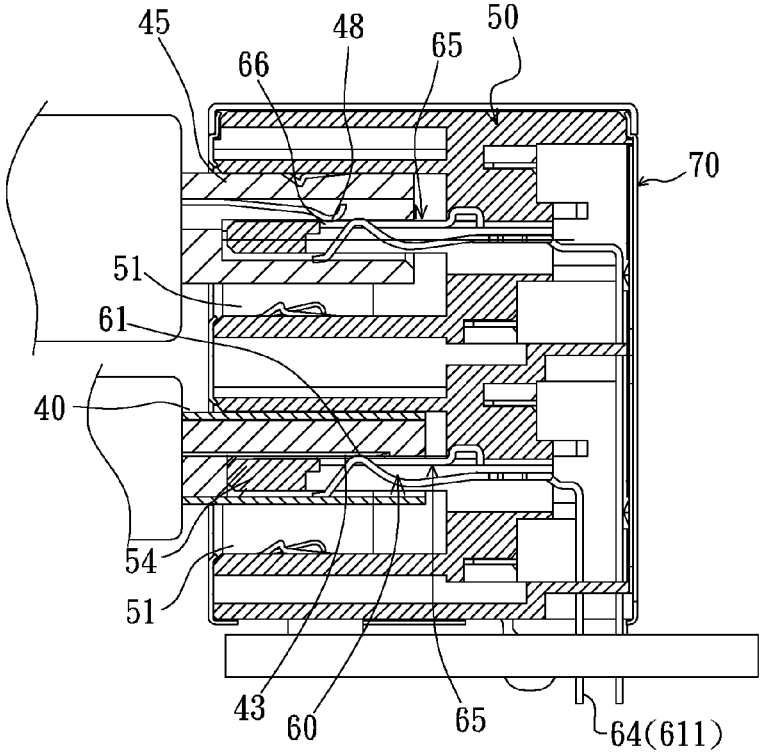
FIG. 15 is a side view showing the usage state of the third embodiment of the invention.

As shown in FIG. 15, when the USB 2.0 connector 40 is inserted into the lower common slot 51, it can be engaged and positioned with the first slot 52. The four terminal connection points 43 of the connector 40 are aligned with and in contact with the contacts 61 of the four first terminals 60 and cannot be in contact with the lower contacts 66 of the seven second terminals 65 so that the function will not be influenced by the short-circuited condition. When the eSATA connector 45 is inserted into the upper common slot 51, it can be engaged and positioned with the second slot 53. The seven terminal connection points 48 are elastic connection points and are thus aligned with and in contact with the contacts 66 of the second terminals 65 to achieve the electrical connection effect. Because the contact 61 of the first terminal 60 is located above the rear section of the tongue and is farther from the inserting port, the connection point 48 of the eSATA connector 45 cannot touch the contact 61 of the first terminal 60 so that the function will not be influenced by the short-circuited condition.

Figure 18:
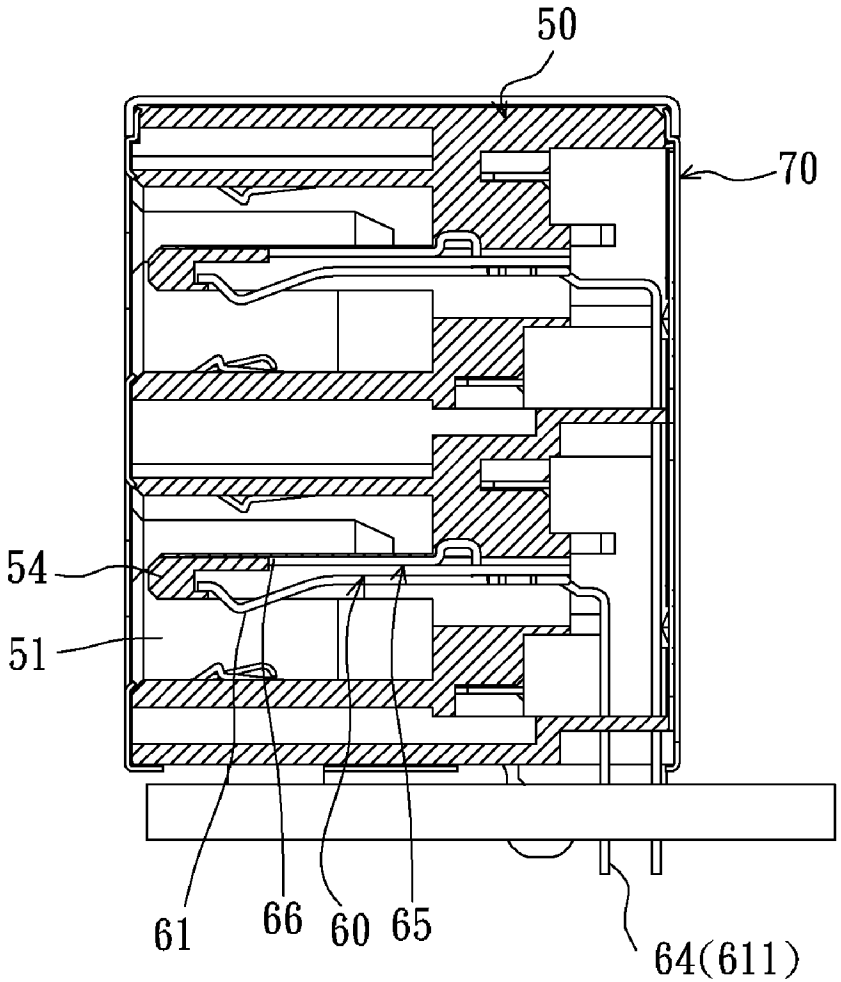
FIG. 18 is an assembled side view showing a fourth embodiment of the invention.

As shown in FIG. 18, the fourth embodiment of the invention is almost the same as the third embodiment except that the contact 61 of the first terminal 60 of this embodiment protrudes downwardly from the tongue 54 so that the contacts 66 of the second terminals 65 and the contacts 61 of the first terminals 60 are respectively disposed above and below the tongue 54. The contact 61 of the first terminal 60 of this embodiment extends to the front end and is closer to the inserting port of the common slot 51. Thus, the inserted USB connector 4U can contact the contact 61 of the first terminal 60 with the longer stroke. However, the space for elastic movement of the contact 61 of the first terminal 60 is smaller.

Figure 20:
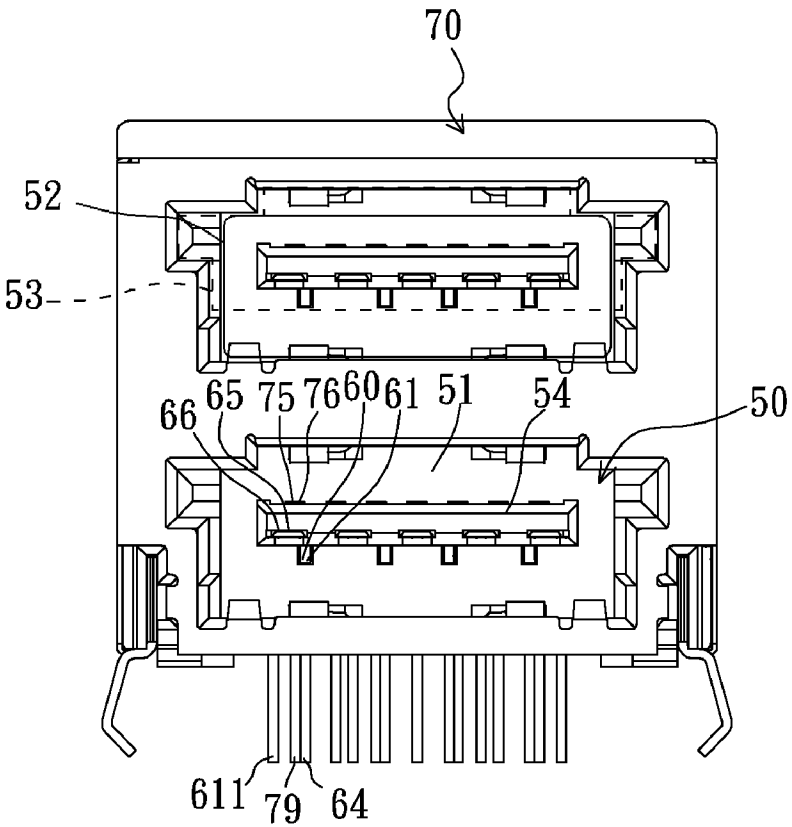
FIG. 20 is an assembled side view showing the fifth embodiment of the invention.
Figure 19:
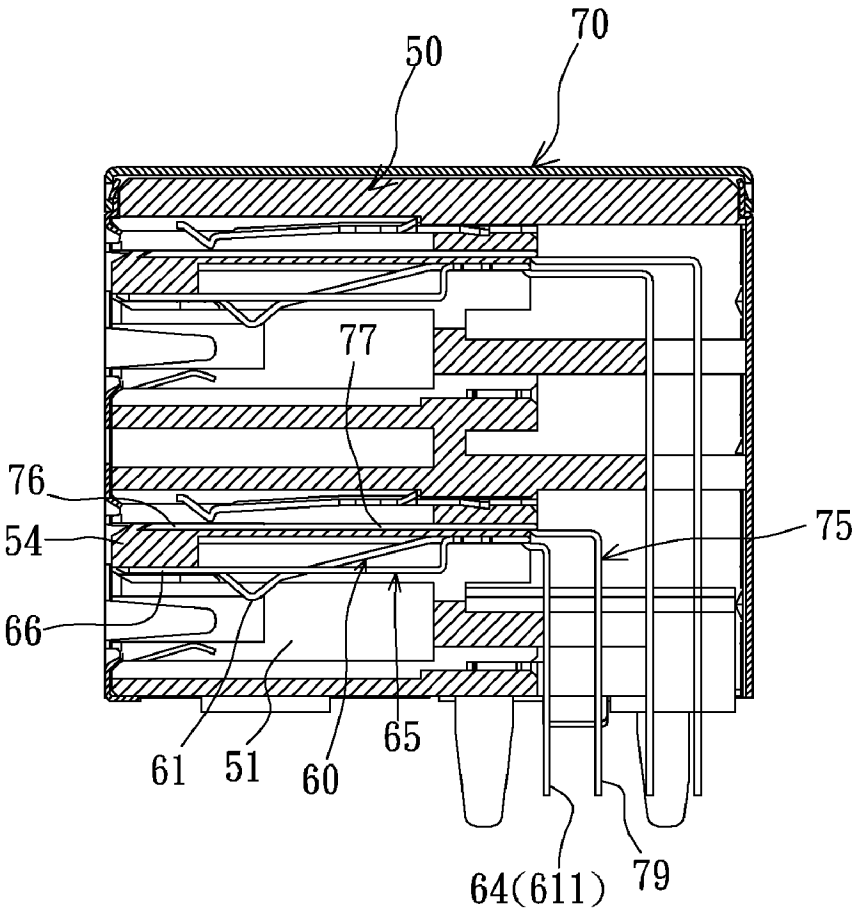
FIG. 19 is an assembled front view showing a fifth embodiment of the invention.

As shown in FIGS. 19 and 20, the fifth embodiment of the invention is almost the same as the second embodiment except that the common slot 51 of this embodiment includes a first slot 52 and a second slot 53. The second slot 53 has a height smaller than that of the first slot 52, and a width greater than that of the first slot 52. The first and second slots 52 and 53 share the same chamber. One USB connector may be inserted into and engaged with the first slot 52. One eSATA connector may be inserted into and engaged with the second slot 53. In addition, one row of third terminals 75 is further disposed in each common slot 51. There are seven third terminals 75 separately mounted on the plastic base 50. The third terminal 75 has a contact 76, an extension 77 and a pin 79. The contact 76 cannot elastically move and is in contact with the top surface of the front section of the tongue 54. The inserted eSATA connector may be electrically connected to the contacts 76 of the third terminals 75. The inserted USB 2.0 connector is electrically connected to the contacts 61 of the first terminals 60. The inserted USB 3.0 connector is electrically connected to the contacts 61 of the first terminals 60 and the contacts 66 of the second terminals 65.

In this embodiment, the USB 2.0 connector, the USB 3.0 connector and the eSATA connector can share this socket structure. So, three rows of terminals are disposed in one common slot. The design of this invention can make the connection projections at the ends of the fixing portion of two rows of terminals be located at the same row so that three rows of terminals are mounted on the plastic base and become two rows to be fixed. Thus, this design is suitable for the ultra-thin tongue.

Figure 21:
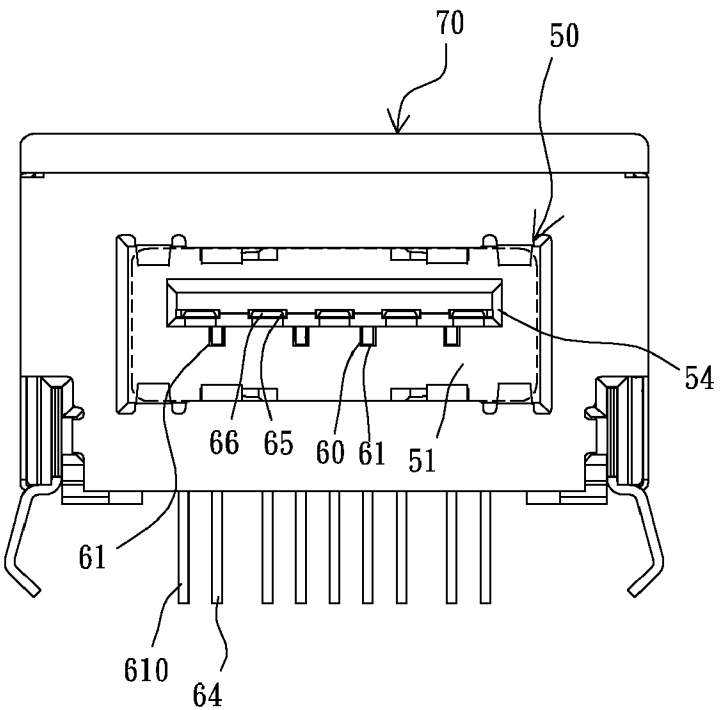
FIG. 21 is an assembled front view showing a sixth embodiment of the invention.

As shown in FIG. 21, the sixth embodiment of the invention is almost the same as the first embodiment except that the plastic base 50 of this embodiment only has the single common slot 51.

Figure 22:
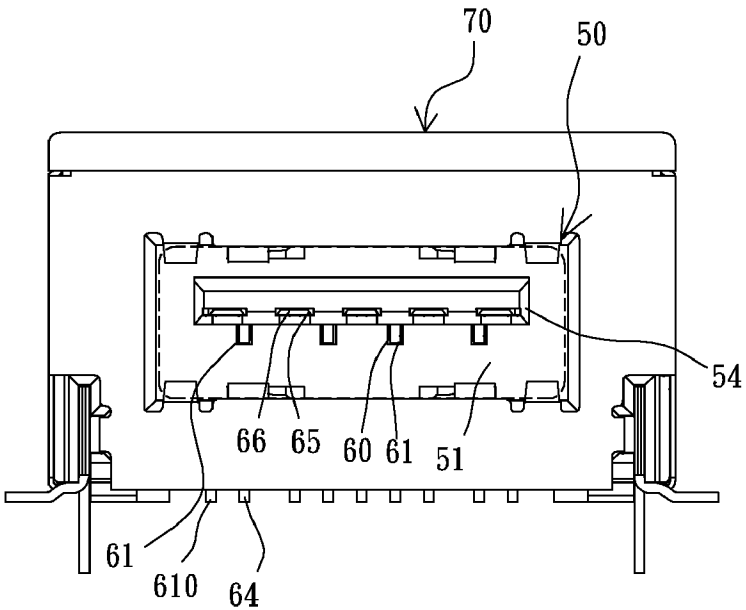
FIG. 22 is an assembled front view showing a seventh embodiment of the invention.

As shown in FIG. 22, the seventh embodiment of the invention is almost the same as the sixth embodiment except that the pins 64 of the first terminals 60 and the pins 611 of the second terminals 65 of this embodiment are horizontal so that the first terminals 60 and the second terminals 65 may be mounted on a circuit board by way of surface mount technology (SMT), whereas the pins of the terminals of the sixth embodiment are longitudinal.

Figure 23:
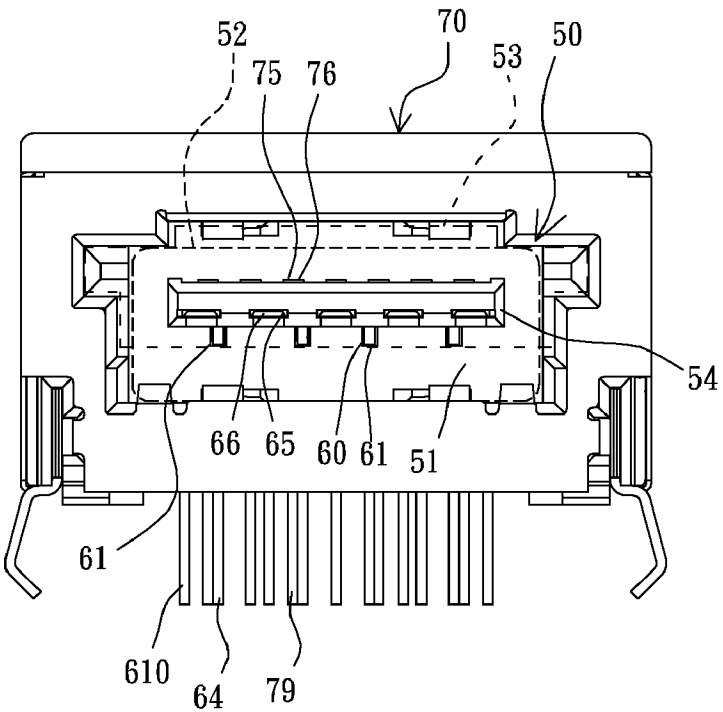
FIG. 23 is an assembled front view showing an eighth embodiment of the invention.

As shown in FIG. 23, the eighth embodiment of the invention is almost the same as the fifth embodiment except that the plastic base 50 of this embodiment only has a single common slot 51.

Figure 24:
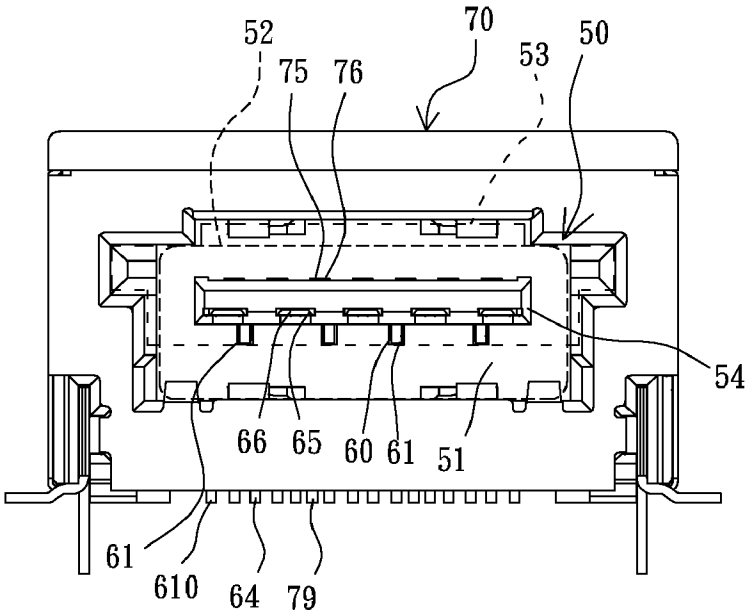
FIG. 24 is an assembled front view showing a ninth embodiment of the invention.

As shown in FIG. 24, the ninth embodiment of the invention is almost the same as the eighth embodiment except that the pins 64 of the first terminals 60, the pins 611 of the second terminals 65 and the pins 79 of the third terminals 75 of this embodiment are horizontal so that they can be mounted on a circuit board by way of surface mounting technology (SMT), whereas the pins of the terminals of the eighth embodiment are longitudinal.

The one row of first terminals and the one row of second terminals of each embodiment are formed on the same copper sheet by way of pressing. In the two rows of terminals after pressing, the rear ends of the fixing portions of the terminals are formed with connection projections and connected to the material tape. After the two rows of terminals are assembled in the plastic base and the material tape is broken, the fixing portions of the two rows of terminals form one row at the same height or level.

In addition, the invention may be implemented on the same copper sheet by way of pressing to form one row of first terminals and one row of second terminals. After pressing, only the rear ends of the fixing portions of one row of terminals are formed with connection projections and connected to the material tape, and the pins of the other row of terminals are connected to the material tape.

After two rows of terminals are assembled into the plastic base and the material tape is broken, a height difference exists between the fixing portions of the two rows of terminals after the terminals are fixed to the plastic base. That is, the two rows of terminals are located at different levels. Thus, the fixing portions of the two rows of terminals cannot be too close to each other. The above-mentioned implementation also pertains to the application range of the invention.

Figure 25:
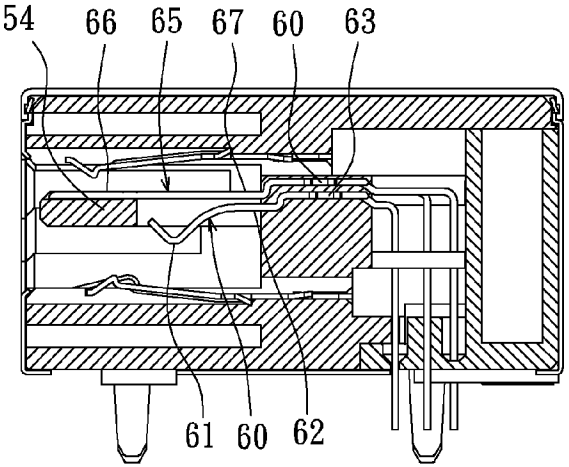
FIG. 25 is an assembled side view showing a tenth embodiment of the invention.

As shown in FIG. 25, the tenth embodiment of the invention is almost the same as the third embodiment except that the one row of first terminals 60 and the one row of second terminals 65 of this embodiment are respectively formed on two metal sheets by way of pressing, and that the fixing portions 63 of the one row of first terminals 60 and the fixing portions 610 of the one row of second terminals 65 are located at different levels.

Figure 26:
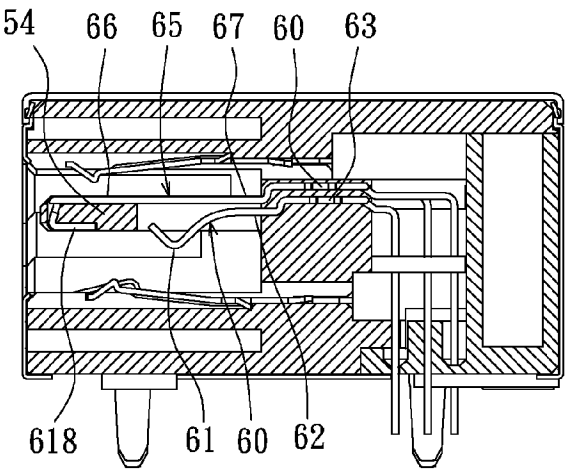
FIG. 26 is an assembled side view showing an eleventh embodiment of the invention.

As shown in FIG. 26, the eleventh embodiment of the invention is almost the same as the tenth embodiment except that each of the front ends of the contacts 66 of the five second terminals 65 of the one row of second terminals 65 of this embodiment is connected to another contact 618. The contact 618 is oppositely bent downward and in surface contact with the lower surface of the front section of the tongue 54. The contact 68 and the contact 66 pertain to the design aspect of common terminals. Thus, the USB 2.0, USB 3.0 and eSATA connector may share this structure.

Figure 27:
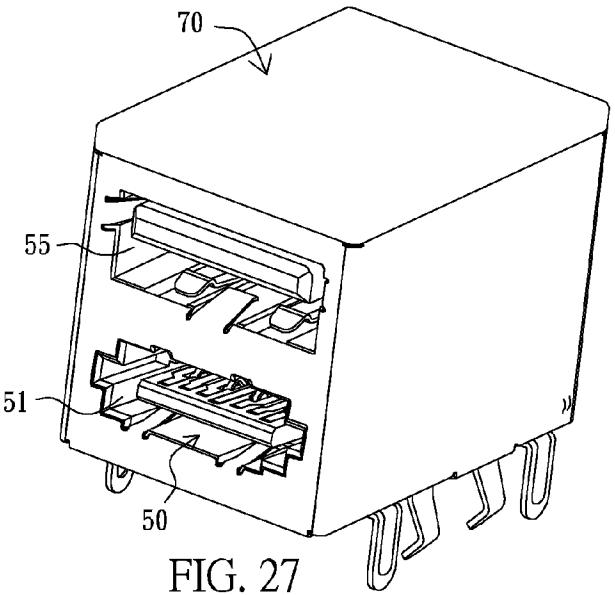
FIG. 27 is a pictorial view showing a twelfth embodiment of the invention.

As shown in FIG. 27, the twelfth embodiment of the invention is almost the same as the thirteenth embodiment except that the plastic base 50 of this embodiment has a common slot 51 for the USB connector and the eSATA connector, and a connection slot 55 for the USB connector. The metal casing 70 covers the plastic base 50 and is formed with the openings for the common slot 51 and the connection slot 55. Similarly, one row of first terminals and one row of second terminals to be electrically connected to the USB 2.0 and eSATA connectors are disposed in the common slot 51, and only one row of first terminals to be electrically connected to the USB 2.0 connector is disposed in the connection slot 55.

Figure 28:
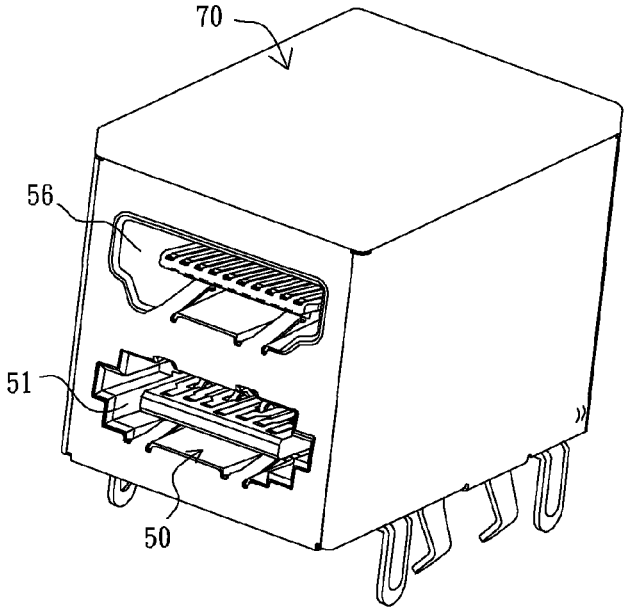
FIG. 28 is a pictorial view showing a thirteenth embodiment of the invention.

As shown in FIG. 28, the thirteenth embodiment of the invention is almost the same as the twelfth embodiment except that this embodiment is the common socket for the eSATA and USB connectors stacked with a socket for the high definition multimedia interface (HDMI). That is, a connection slot 56 for the HDMI connector is stacked above the common slot 51 of the plastic base 50. Terminals for the HDMI connector are disposed in the connection slot 56.

Figure 29:
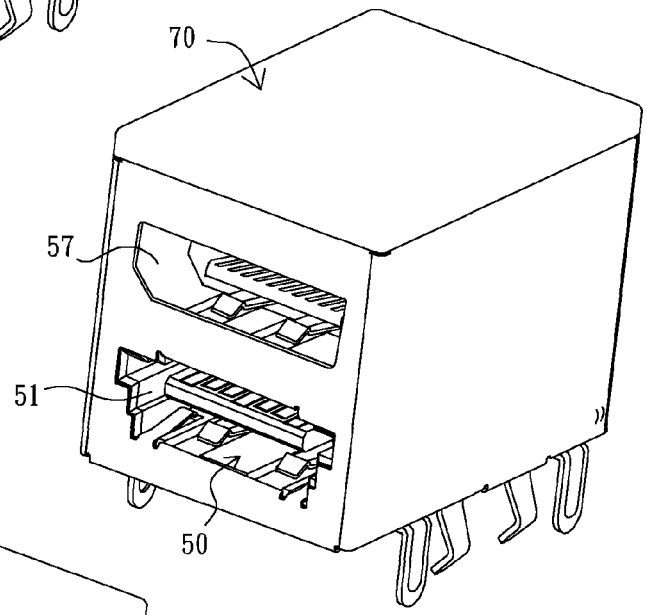
FIG. 29 is a pictorial view showing a fourteenth embodiment of the invention.

As shown in FIG. 29, the fourteenth embodiment of this invention is almost the same as the fifth embodiment except that the common socket for the eSATA connector and the USB connector of this embodiment is stacked with a common socket for the HDMI connector and the display port connector. That is, the plastic base 50 has a common slot 51 for a USB connector and an eSATA connector, and a common slot 57 for the HDMI connector and the display port connector. Three rows of terminals to be connected to the eSATA connector, the USB 2.0 connector and the USB3.0 connector are disposed in the common slot 51, and terminals to be connected to the HDMI connector and the display port connector are disposed in the common slot 57.

Figure 30:
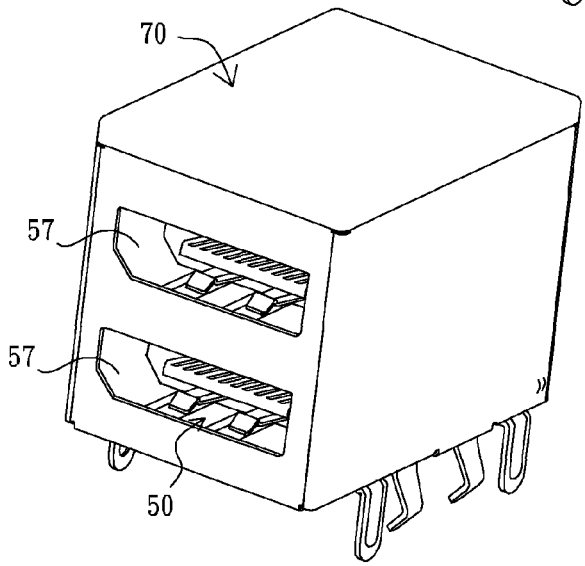
FIG. 30 is a pictorial view showing a fifteenth embodiment of the invention.

As shown in FIG. 30, the fifteenth embodiment of the invention is almost the same as the fourteenth embodiment except that this embodiment is a common socket for two HDMI connectors and the display port connector. That is, the plastic base 50 has a common slot 57 for two HDMI connectors and the display port connector.

The sharable socket structure mentioned hereinabove has two layers. However, three or more than three layers may be designed in the socket structure. In addition, other types of sockets, such as the 1394 socket or various phone sockets, may also be stacked.

While the invention has been described by way of examples and in terms of preferred embodiments, it is to be understood that the invention is not limited thereto. To the contrary, it is intended to cover various modifications. Therefore, the scope of the appended claims should be accorded the broadest interpretation so as to encompass all such modifications.

What is claimed is:

1. A sharable socket structure, comprising:

a plastic base having a common slot for accommodating at least two connectors with different connection interfaces, wherein a front end of the common slot is formed with an inserting port and a tongue is disposed in the common slot;

one row of first terminals separately arranged in the plastic base, wherein each of the first terminals has a contact, an extension, a fixing portion and a pin, wherein the contacts of the first terminals are disposed on the tongue in the common slot, and the contacts of the first terminals are electrically connected to one of the at least two connectors; and one row of second terminals separately arranged in the plastic base, wherein each of the second terminals has a contact, an extension, a fixing portion and a pin, the contacts of the second terminals are disposed on the tongue in the common slot, the contacts of the second terminals are closer to the inserting port than the contacts of the first terminals are, the contacts of the second terminals are to be electrically connected to the other of the at least two connectors, X coordinates of the contact and the extension of the one row of first terminals and the extensions of the one row of second terminals are staggered in a sequentially arranging direction of the terminals, and a step is formed between the X coordinates of the contact and the extension of at least one of the second terminals such that the contact of the second terminal partially overlaps with the contact of the first terminal neighboring the second terminal on the X coordinates, wherein:

the contacts of the second terminals are in contact with the tongue and cannot elastically move, and the contacts of the first terminals protrude from the tongue and may elastically move up and down; and the sharable socket structure is a USB 3.0 socket capable of being electrically connected to a USB 3.0 connector and a USB 2.0 connector, the total number of the first terminals is equal to four, the total number of the second terminals is equal to five, the contact of the first terminal is electrically connected to the USB 2.0 connector, and the contacts of the first and second terminals are electrically connected to the USB 3.0 connector.

2. The sharable socket structure according to claim 1, further comprising a metal casing for covering the plastic base, wherein one surface of the metal casing is formed with an opening for exposing the common slot of the plastic base.

3. The sharable socket structure according to claim 1, wherein the X coordinates of the fixing portions of the one row of first terminals and the one row of second terminals are completely staggered in the sequentially arranging direction of the terminals.

4. The sharable socket structure according to claim 1, wherein the common slot accommodates two USB connectors with different connection interfaces.

5. The sharable socket structure according to claim 1, wherein the contacts of the second terminals and the contacts of the first terminals are disposed on the same surface of the tongue in the common slot.

6. The sharable socket structure according to claim 1, wherein a turning portion is formed between the contact and the extension of the at least one second terminal.

7. A sharable socket structure, comprising:

a plastic base having a common slot for accommodating at least two connectors with different connection interfaces, wherein a front end of the common slot is formed with an inserting port and a tongue is disposed in the common slot;

one row of first terminals separately arranged in the plastic base, wherein each of the first terminals has a contact, an extension, a fixing portion and a pin, wherein the contacts of the first terminals are disposed on the tongue in the common slot, and the contacts of the first terminals are electrically connected to one of the at least two connectors; and one row of second terminals separately arranged in the plastic base, wherein each of the second terminals has a contact, an extension, a fixing portion and a pin, the contacts of the second terminals are disposed on the tongue in the common slot, the contacts of the second terminals are closer to the inserting port than the contacts of the first terminals are, the contacts of the second terminals are to be electrically connected to the other of the at least two connectors, X coordinates of the contact and the extension of the one row of first terminals and the extensions of the one row of second terminals are staggered in a sequentially arranging direction of the terminals, and a step is formed between the X coordinates of the contact and the extension of at least one of the second terminals such that the contact or the second terminal partially overlaps with the contact of the first terminal neighboring the second terminal on the X coordinates, wherein:

the common slot comprises a first slot and a second slot for accommodating the at least two connectors, and the first slot and the second slot share a chamber; and the first slot can accommodate one USB connector, the second slot can accommodate one eSATA connector, and the sharable socket structure further comprises one row of seven third terminals, wherein each of the third terminals has a contact disposed on the tongue to face the contacts of the first and second terminals, the contacts of the third terminals are to be electrically connected to the eSATA connector, the total number of the first terminals is equal to four, the total number of the second terminals is equal to five, and the contacts of the first and second terminals are to be electrically connected to the USB connector.

8. A sharable socket structure, comprising:

a plastic base having a common slot for accommodating at least two connectors with different connection interfaces, wherein a front end of the common slot is thrilled with an inserting port and a tongue is disposed in the common slot;

one row of first terminals separately arranged in the plastic base, wherein each of the first terminals has a contact, an extension, a fixing portion and a pin, wherein the contacts of the first terminals are disposed on the tongue in the common slot, and the contacts of the first terminals are electrically connected to one of the at least two connectors; and one row or second terminals separately arranged in the plastic base, wherein each of the second terminals has a contact, an extension, a fixing portion and a pin, the contacts of the second terminals are disposed on the tongue in the common slot, the contacts of the second terminals are closer to the inserting port than the contacts of the first terminals are, the contacts of the second terminals are to be electrically connected to the other of the at least two connectors, X coordinates of the contact and the extension of the one row of first terminals and the extensions of the one row of second terminals are staggered in a sequentially arranging direction of the terminals, and a step is formed between the X coordinates or the contact and the extension of at least one of the second terminals such that the contact of the second terminal partially overlaps with the contact of the first terminal neighboring the second terminal on the X coordinates, wherein:

the one row of first terminals and the one row of second terminals are formed on the same metal sheet by way of pressing and connected to a material tape, the material tape and the first and second terminals are plated so that the one row of first terminals and the one row of second terminals are formed with plating layers, ends of the fixing portions of at least one row of terminals of the one row of first terminals and the one row of second terminals connected to the pins are formed with connection projections each having a broken surface without the plating layer, and all the connection projections having the broken surfaces without the plating layer are disposed on the same row and the same level; and the one row or first terminals and the one row of second terminals are formed with the connection projections, which are disposed on the same row and on the same level.

9. The sharable socket structure according to claim 8, wherein the common slot comprises a first slot and a second slot for accommodating the at least two connectors, and the first slot and the second slot share a chamber.

10. The sharable socket structure according to claim 9, wherein the first slot can accommodate one USB connector, the second slot can accommodate one eSATA connector, the total number of the second terminals is equal to seven, the contacts of the second terminals are electrically connected to the cSATA connector, the total number of the first terminals is equal to four, and the contacts of the first terminals are electrically connected to the USB connector.

* * * * *